United States Patent [19]

Dobinson

[11] 4,173,884

[45] Nov. 13, 1979

[54] FORMING MACHINE FOR BENDING METAL BARS

[76] Inventor: Reginald P. Dobinson, 290 Murray St., Rockhampton, Queensland, Australia

[21] Appl. No.: 878,020

[22] Filed: Feb. 15, 1978

[51] Int. Cl.[2] ..... B21D 7/024

[52] U.S. Cl. ..... 72/387

[58] Field of Search ..... 72/387, 388, 310, 319, 72/298, 216

[56] References Cited

U.S. PATENT DOCUMENTS

| | | | |
|---|---|---|---|
| 2,430,899 | 11/1947 | Wallace | 72/388 |
| 2,971,224 | 2/1961 | Overholser | 72/319 |
| 3,260,091 | 7/1966 | Shaw | 72/388 |
| 4,052,875 | 10/1977 | Sakamoto | 72/387 |

*Primary Examiner*—Francis S. Husar
*Assistant Examiner*—Gene P. Crosby
*Attorney, Agent, or Firm*—J. Harold Nissen

[57] ABSTRACT

An apparatus is provided for shaping metal bars, particularly for forming eyes in spring leaves. The forming machine includes a table supported on a main frame and rotatable about an axis, a mandrel extending from the table about the axis, a positionable back stop member on the frame adapted to be operatively engaged with the work piece which is to be formed about the mandrel, a jaw assembly actuable to clamp the workpiece against the mandrel, and means to rotate the table to form the workpiece about the mandrel.

9 Claims, 2 Drawing Figures

FORMING MACHINE FOR BENDING METAL BARS

This invention relates to a forming machine for shaping metal bars and in particular it relates to a machine for forming eyes in spring leaves.

At present machines for rolling eyes in spring leaves fall into two main categories, namely large machines which are very expensive but which are suitable for production runs, and small hand operated machines which are only suitable for jobbing work. The presently available large type machines have the disadvantage that they take a long time to set up for a particular size spring leaf and for a particular size eye and they are expensive to purchase.

The present invention aims to provide a relatively inexpensive machine which will be suitable for production runs and for jobbing work and which will provide facilities enabling quick change from one set up to another. Other objects and advantages of the invention will become apparent from the following description.

With the foregoing and other objects in view, this invention comprises a forming machine including a table supported on a main frame and rotatable about a support axis; a mandrel adapted to extend from said table about said support axis; a selectively positionable back-stop member supported on said main frame and adapted for operative engagement with the workpiece to be formed about said mandrel; a jaw assembly on said rotatable table and adapted to be actuated to clamp said workpiece against said mandrel; means for rotating said table to form said workpiece about said mandrel, and means for axially displacing said mandrel to clear same from the formed workpiece.

The mandrel is normally supported between upper and lower hydraulic rams which may be reciprocated to force the mandrel from the rolled eye to enable the formed member to be removed from the machine. The jaw is adapted to be positioned relative to the mandrel by hydraulic means as is the back-stop whereby the whole operation of the machine can be controlled remotely by an operator. Of course, another actuation could be utilised.

In order that the invention may be more readily understood and put into practical effect, reference will now be made to the accompanying drawings which illustrate a preferred embodiment of the invention and wherein.

Figure 1:
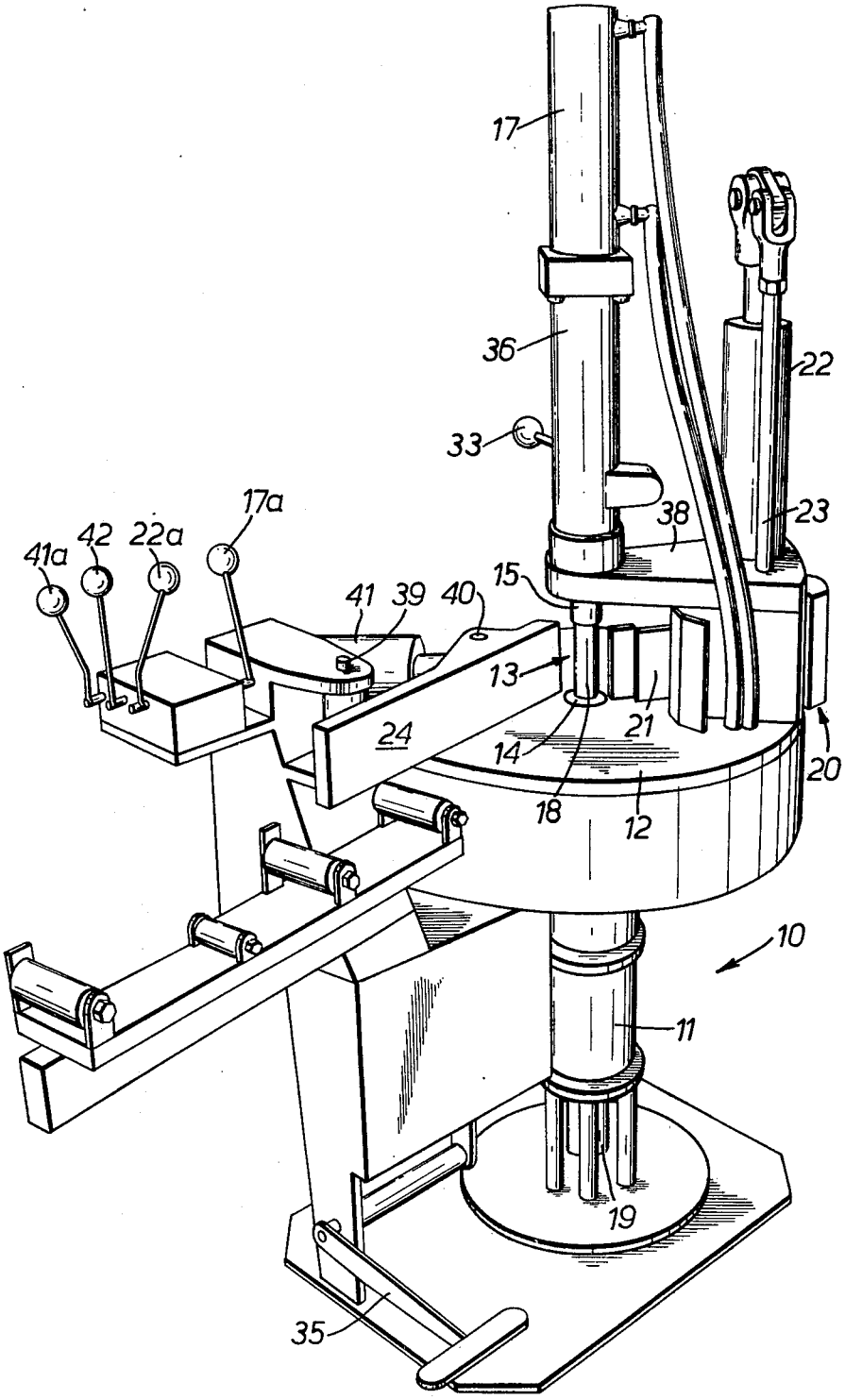
FIG. 1 is the perspective view of a forming machine in accordance with the present invention.
Figure 2:
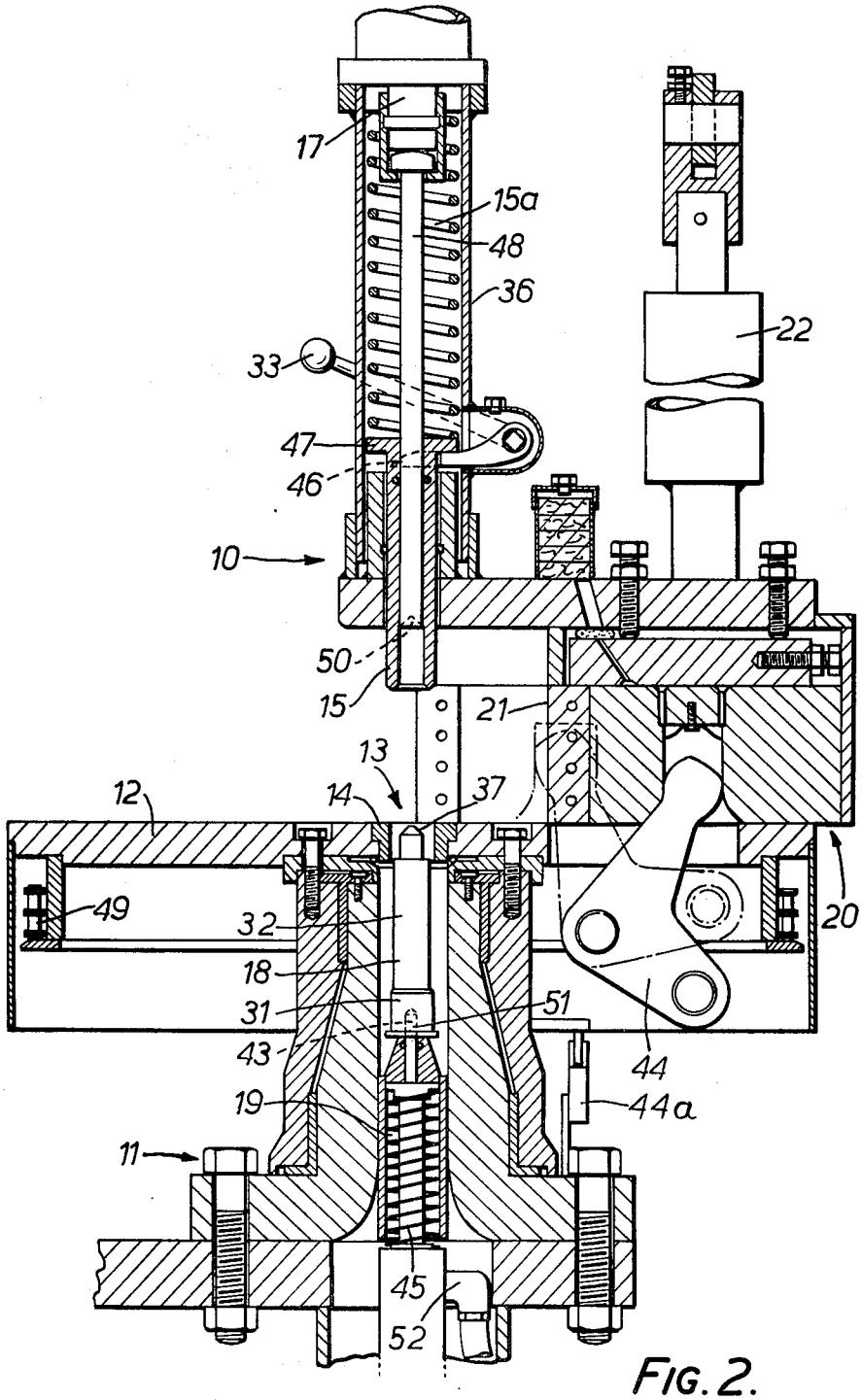
FIG. 2 is a cross-sectional view of the forming machine.

As can be seen from the drawings, the forming machine 10 includes a fixed support pedestal 11 on which an upper circular table portion 12 is rotatably supported. The centre of the table 12 is apertured to permit location of a mandrel and bush assembly 13. The mandrel 18 is supported radially at its lower end by the bush 14 and its upper end is supported within the cylindrical top supporting sleeve 15 supported centrally and slidably within the vertical support tube 36. The sleeve 15 is urged downwards by the spring **15*a* to its operative lower position as shown, but it may be lifted by operating the hand lever 33 which has an internal forked part 46 extending beneath an upper abutment face 47 externally of the sleeve 15. The sleeve 15 is raised only to permit the mandrel 18 to be removed and replaced. The support tube 36 supports a hydraulic ram 17 at its upper end and the push-rod of this ram co-operates with an extension shaft 48 which passes down through the sleeve 15 to locate about the spigot 37**.

The upper ram 17 can be extended to force the mandrel 18 downwards through the support bush 14 into the hollow support pedestal 11 and against the effect of a lower spring-loaded hydraulic ram 19. This ram 19 normally urges the mandrel 18 upwards, and its fluid outlets, one of which is shown at 52, at opposite sides of the piston of the ram are coupled together through a hydraulic check valve arranged so that when the ram is retracted against the action of its spring 45 it is retained in its retracted position by the check valve. A poppet valve is coupled in parallel across the check valve to enable the fluid to bypass the check valve whereby the ram is spring urged upwards to urge the mandrel 18 back to its normal operative position.

The poppet valve is operated by a cam located under and affixed to the table 12 so that it will be opened when the table is disposed in a position between its starting position and, say, ninety degrees therefrom. Thus, after the formed eye has been removed from the machine subsequent to forcing the mandrel 18 through the bush 14 as aforesaid, and the table 12 is rotated back towards its starting position; the cam supported thereon will open the poppet valve and the mandrel 18 will move upwards ready for the next operation.

A jaw assembly 20 for clamping the workpiece to the mandrel 18 is provided at one side of the table and it includes a jaw member 21 which is adapted to be reciprocated across the table towards or away from the mandrel 18 by a hydraulic cylinder 22 connected thereto through a bellcrank assembly 44 by means of equalising the transfer levers 23. The jaw assembly is fixed to the rotatable table 12 and it provides a cantilever support 38 for the vertical tube 36 which supports the upper ram 17. A rigid back-stop member 24 is pivotally supported at 39 on the main frame for pivotal movement about a vertical axis to and from the pin 13. The back-stop member 24 is connected at 40 to a double acting control ram 41 which may be actuated to position the back-stop member 24 at the desired distance from the adjacent surface of the mandrel 18 equal to or just greater than the thickness of the workpiece in which the eye is to be formed.

The back-stop ram 41 is controlled by the lever **41*a*, the upper ram 17 is controlled by the lever 17*a*, and the jaw actuating ram 22 is controlled by the lever 22*a*. The lever 42 controls the hydraulic motor which rotates the turntable 12 and the pedal 35** controls the speed of operation of the machine.

In use, the selected mandrel is placed into the central aperture in table 12 with its corresponding support bush 14 by raising the sleeve 15 with the hand lever 33 to provide adequate clearance above the table 12. If, say, an eye is to be formed at one end of a spring leaf, then firstly, that end is heated and scarfed and while still hot is placed on the machine against the back-stop 24 which is adjusted by the lever **41*a* to lie parallel with the leaf when the latter abuts the mandrel 18. The jaw 21 is then moved by the lever 22*a*** into clamping engagement with the back face of the scarfed end of the leaf and the table is rotated clockwise approximately two hundred and twenty degrees to partly form the eye.

The jaw 21 is then retracted and the table rotated back about one hundred and eighty degrees in an anticlockwise direction and again the jaw member 21 is clamped against the partly formed eye. The table 12 is then rotated until the eye is complete. The upper ram 17 is then actuated by the lever 17*a* to push the mandrel 18 down through the formed eye and the table 12 against the spring loaded hydraulic ram 19, the upper end of which engages in the socket 43 at the underside of the mandrel 18. The check valve maintains the mandrel in the depressed position so that the upper ram 17 may be raised to clear the table and to enable the formed leaf to be removed. As the table is rotated back to its starting position the poppet valve 44*a* is automatically actuated causing the spring-urged hydraulic ram 19 to force the mandrel 18 back up through its bush 14 to its operative position with its upper end located in the sleeve 15.

It will be appreciated that the jaw as shown in FIG. 1 has advanced about one hundred and thirty degrees from its starting position at which it is at the same side of the mandrel 18 as the back-stop member 24. The table is driven by a chain 49 from a five cylinder slow speed hydraulic motor, in the preferred embodiment, but of course gear means could be used for this purpose.

In order to prevent jamming of the mandrel 18 there is provision in the hollow support pedestal 11 to allow scale and dirt to fall through. This is achieved by providing deep splines about the ram 19 to space the ram from the support pedestal 11.

An advantage of the present machine is that the eye diameter can be easily varied by replacing the installed mandrel with another of a different diameter. Each mandrel is of the same length with an upper spigot 37 adapted to co-operate with the lower end 50 of the extension shaft 48 of the upper ram 17, and the socket 43 at its lower end co-operates with the upper end 51 of the ram 19. Each mandrel is provided with its respective support bush 14 which is apertured centrally at 30 to accommodate the respective diameter of the lower end portion 31 which is just slightly larger than the mandrel bearing portion 32. To replace the mandrel assembly 13 the handle 33 is raised to retract the sleeve 15 within the tube 36. The mandrel 18 and its associated bush 14 can then be lifted from the table and replaced by another mandrel set, including the mandrel 18 and its respective bush 14. This operation can be achieved very quickly so that the set up time of the machine is very short. Furthermore, as the jaw and the back-stop and other functions are controlled hydraulically from a control panel 34 the time to adjust the machine for various circumstances and to actually perform the forming action is very short, and is carried out from a remote operating station. An accelerator pedal 35 is provided so that the functions can be sped up or their speed decreased according to the operator.

As the end of a spring leaf is heated for forming purposes, the hollow pedestal 11 may include water cooling means to cool the mandrel 18 when it is retracted. This would not slow down the cycle of operations and would ensure that the machine could operate continuously. The controls of the machine could be automated and coupled to a feeding mechanism for full automatic operation. To facilitate this, the machine could be disposed horizontally if necessary.

Of course, various hydraulic control means may be utilised and many modifications may be made to the above-described embodiment of the invention by persons skilled in the art without departing from its broad scope and ambit as is defined in the appended claims.

I claim:

1. A forming machine including a table supported on a main frame and rotatable about a support axis; a mandrel adapted to extend from said table about said support axis; a selectively positionable back-stop member supported on said main frame and adapted for operative engagement with the workpiece to be formed about said mandrel; a jaw assembly on said rotatable table and adapted to be actuated to clamp said workpiece against said mandrel; means for rotating said table to form said workpiece about said mandrel, and means for axially displacing said mandrel to clear same from the formed workpiece.

2. A forming machine according to claim 1, wherein the said back-stop member comprises an elongate member connected pivotally to said main frame at its end remote from said mandrel and connected, at its end adjacent said mandrel, to a remotely operable double acting hydraulic ram actuable to position said back-stop member at the desired distance from said mandrel.

3. A forming machine according to claim 1, wherein said jaw assembly includes a jaw member supported reciprocably in a housing fixed to said table for movement towards or away from said mandrel and a remotely operable hydraulic ram assembly operatively connected to said jaw member and actuable to extend said jaw member towards said mandrel to clamp the workpiece thereagainst, or to retract said jaw member to clear said workpiece.

4. A forming machine according to claim 3, wherein said hydraulic ram extends parallel to said support axis and is connected to said jaw member by means of a transfer linkage.

5. A forming machine according to claim 4, wherein said housing for said jaw member is adapted to support a sleeve disposed co-axially with and reciprocable about said support axis and spring-urged towards an operative position at which said sleeve operatively supports the end of said mandrel remote from said table and there being provided means to move said sleeve to an inoperative position clear of said mandrel.

6. A forming machine according to claim 1, wherein said mandrel is supported axially slidable in an aperture in said table and is adapted to be operatively positioned in the axial direction by means of a remotely operable hydraulic ram, whereby said mandrel may be retracted through said table to enable the workpiece formed thereabout to be removed.

7. A forming machine according to claim 6, wherein there is provided a support member supported on said table and actuable between an operative position at which said support member supports the end of said mandrel remote from said table to support same during forming operations, and an inoperative position at which said support member is clear of said mandrel whereby the latter may be lifted from said table.

8. A forming machine according to claim 6, wherein said support member is in the form of a sleeve reciprocable about said support axis and spring-urged towards said operative position and there being provided manually operable means to retract said sleeve to said inoperative position to enable said mandrel to be removed from said table.

9. A forming machine according to claim 5, wherein said mandrel is supported axially slidable in a central aperture in said table and is axially positioned between a remotely operable hydraulic ram co-operating with said remote end of said mandrel through a push-rod passing through said sleeve and actuable to urge said mandrel axially through said table and oppositely arranged spring means adapted to force said mandrel into operative engagement with said push-rod and wherein said aperture in said table for supporting said mandrel is formed in a removable bush whereby the aperture size maybe easily varied to suit the selected mandrel.

* * * * *